US011255502B2

(12) United States Patent
Jiang

(10) Patent No.: US 11,255,502 B2
(45) Date of Patent: Feb. 22, 2022

(54) STAGE LIGHT HAVING EFFECT ELEMENT MADE OF CERAMIC MATERIAL

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/172,783

(22) Filed: Feb. 10, 2021

(65) Prior Publication Data

US 2021/0164629 A1 Jun. 3, 2021

Related U.S. Application Data

(63) Continuation of application No. PCT/CN2020/072095, filed on Jan. 14, 2020.

(30) Foreign Application Priority Data

Aug. 31, 2019 (CN) ..... 201921434625.3

(51) Int. Cl.
*F21S 10/00* (2006.01)
*F21V 14/00* (2018.01)
*F21W 131/406* (2006.01)

(52) U.S. Cl.
CPC ..... *F21S 10/007* (2013.01); *F21V 14/00* (2013.01); *F21W 2131/406* (2013.01)

(58) Field of Classification Search
CPC ..... F21S 10/007
See application file for complete search history.

(56) References Cited

U.S. PATENT DOCUMENTS 5,806,951 A * 9/1998 Roman ..... F21S 10/007 353/30
10,648,654 B2 * 5/2020 Jiang ..... F21V 29/70
2018/0299110 A1 * 10/2018 Asano ..... G03B 21/14
(Continued)

FOREIGN PATENT DOCUMENTS

CN 102943996 A 2/2013
CN 202993064 U 6/2013
CN 203823662 U 9/2014
(Continued)

*Primary Examiner* — Alexander K Garlen
(74) *Attorney, Agent, or Firm* — Muncy, Geissler, Olds & Lowe, P.C.

(57) ABSTRACT

A stage light having an effect element made of a ceramic material comprises a light source, an effect element, and a driving component connected to the effect element. The light emitted by the light source forms a light beam, the effect element is made of a ceramic material, and the driving component drives the effect element to rotate or move relative to the light beam so as to enable the light beam to generate a corresponding lighting effect. The stage light having an effect element made of a ceramic material has abundant effects by the effect element made of a ceramic material. Since ceramic is less susceptible to thermal deformation and has a higher temperature resistance than metal, making the effect element with a ceramic material can effectively reduce thermal deformation and cracking, thereby prolonging the service life of the effect element.

12 Claims, 3 Drawing Sheets

(56) References Cited

U.S. PATENT DOCUMENTS

| | | | | | |
|---|---|---|---|---|---|
| 2020/0089092 | A1* | 3/2020 | Yamagishi | ..... | F21S 10/007 |

FOREIGN PATENT DOCUMENTS

| | | | | | |
|---|---|---|---|---|---|
| CN | 207729518 | U | 8/2018 | | |
| CN | 208418539 | U | 1/2019 | | |
| EP | 3588187 | A1 * | 1/2020 | ..... | F21S 10/007 |
| GB | 2294909 | A * | 5/1996 | ..... | F21S 10/007 |
| WO | WO-0122001 | A1 | 3/2001 | | |
| WO | WO-2013072881 | A * | 5/2013 | ..... | F21S 10/02 |

* cited by examiner

STAGE LIGHT HAVING EFFECT ELEMENT MADE OF CERAMIC MATERIAL

CROSS REFERENCE TO RELATED APPLICATIONS

The present application is a continuation of International Application No. PCT/CN2020/072095, filed on Jan. 14, 2020, which claims priority from Chinese Patent Application No. 201921434625.3 filed on Aug. 31, 2019, all of which are hereby incorporated herein by reference.

TECHNICAL FIELD

The present invention relates to the technical field of stage lights, and in particular to a stage light having an effect element made of a ceramic material.

BACKGROUND ART

With the increasing use of stage lights, the requirements for stage lights are getting higher, and brightness is one of key evaluation indexes. With the continuous improvement of the brightness of stage lights, higher requirements are put forward for the heat resistance of various elements in the stage lights, especially for various effect elements which are directly exposed to light beams, the temperature will rise rapidly.

At present, an effect element of a stage light is generally made of an alloy material, but the requirement of high-power stage lights cannot be met, and the effect element may often suffer from irreversible thermal deformation or breaking due to the fact that the effect element cannot withstand high temperature caused by light beams, thus causing damage to affect the performance effect of the stage light.

SUMMARY OF THE INVENTION

In order to overcome at least one defect in the prior art, the present invention provides a stage light having an effect element made of a ceramic material.

The present invention provides a stage light having an effect element made of a ceramic material, comprising a light source, an effect element, and a driving component connected to the effect element, wherein light emitted by the light source forms a light beam, the effect element is made of a ceramic material, and the driving component drives the effect element to rotate or move relative to the light beam so as to enable the light beam to generate a corresponding lighting effect.

The stage light having an effect element made of a ceramic material has abundant effects by means of the effect element made of a ceramic material. Since ceramic is less susceptible to thermal deformation and has a higher temperature resistance than metal, making the effect element with a ceramic material can effectively reduce thermal deformation and cracking, thereby prolonging the service life of the effect element.

The stage light further comprises a fixing mechanism for fixing the effect element to the driving component. An elastic pad is provided at a position where the effect element is connected to the fixing mechanism. Since the ceramic is more fragile than metal, the elastic pad can buffer the vibration of the effect element or prevent the effect element from being damaged due to excessive pressure during clamping.

The effect element can be one or more components selected from the group of a blade of an aperture, a cutting blade of a cutter, a stroboscopic sheet, a gobo sheet on a rotating gobo wheel, a fixed gobo wheel, and a dynamic gobo wheel. After the light beam passes through the effect element, one or more effects of light beam cutting, stroboflash, gobo rotation, specific gobos and dynamic gobos can be correspondingly generated, such that the stage light has more diversified functions.

Preferably, the effect element is a dynamic gobo wheel, the dynamic gobo wheel is provided with a plurality of hollowed-out holes or transparent areas for generating a lighting effect, and the periphery of the dynamic gobo wheel is provided with a buffer pad. By means of providing the hollowed-out holes or the transparent areas, a dynamic effect of flame, white cloud, flowing water, starry sky, etc. can be realized to achieve the gorgeous effect of the stage light. In addition, since the dynamic gobo wheel generally has relatively large displacement, and considering that the ceramic material is more fragile than metal, the buffer pad is provided at the periphery of the dynamic gobo wheel, so as to prevent damage caused by collision or scratching during the operation of the dynamic gobo wheel.

The buffer pad is in form of ring-shaped, and covers the periphery of the dynamic gobo wheel. The dynamic gobo wheel is wrapped all around with an annular structure.

In order to achieve movement of the effect element, the driving component comprises a movement driving mechanism. The movement driving mechanism comprises a swing arm, a mechanical connecting rod, and a movement driving electric motor. The effect wheel is pivoted to the swing arm, the swing arm is pivoted to a mounting plate by a rotary pivoting shaft, and a rotating shaft of the movement driving electric motor is connected to the swing arm by means of the mechanical connecting rod.

Preferably, the mechanical connecting rod includes a first connecting rod and a second connecting rod. The first connecting rod is connected to the rotating shaft of the movement driving electric motor, and is further pivoted to one end of the second connecting rod. The other end of the second connecting rod is connected to the swing arm.

In order to achieve rotation of the effect element, the driving component comprises a rotation driving mechanism. The rotation driving mechanism comprises a rotation driving electric motor, a rotation driving gear, a first rotation driven gear, and a second rotation driven gear. The rotation driving gear is fixedly connected to a rotating shaft of the rotation driving electric motor. The second rotation driven gear is fixed to the effect wheel, and the first rotation driven gear is respectively connected to the rotation driving gear and the second rotation driven gear by a first synchronous belt and a second synchronous belt.

The first rotation driven gear is preferably pivoted to the rotary pivoting shaft.

The swing arm is preferably in hollow, which can accommodate the second synchronous belt. Movement and rotation of the effect wheel simultaneously can be achieved in such easy method.

That is, the effect element can be driven to move or rotate respectively, or to more or rotate simultaneously. The effect element is driven by the movement driving mechanism to switch in and out a light path, and to rotate by the rotation driving mechanism, thereby generating a varied dynamic effect.

The ceramic material for making the effect element is preferably black or gray. With the light absorption property of the black or gray color, the light transmission of the effect element is reduced.

According to one embodiment, at least one side surface, away from the light source, of the effect element is spray-coated with black paint. After the light beam passes through the effect element, stray light reflected by other elements can be absorbed by the surface, spray-coated with black paint, of the effect element. Meanwhile, the spray-coating with black paint can reduce the light transmission of the effect element to achieve a better shading effect.

The effect element has a thickness of 0.2 mm to 1.5 mm. As such, the effect element can be made light in weight and thin enough on the premise of ensuring the opacity.

The effect element is preferably made of a ceramic material covered with a base material, or the effect element is entirely made of a ceramic material.

DETAILED DESCRIPTION OF EMBODIMENTS

The accompanying drawings are merely for exemplary illustration and are not to be construed as limiting the present patent. For better illustration of the embodiments, some components in the figures may be omitted, scaled up or scaled down, which does not represent the actual size of a product. For those skilled in the art, it would have been appreciated that some well-known structures in the figures and the illustration thereof could be omitted. The position relationship described in the figures are merely for exemplary illustration and are not to be construed as limiting the present patent.

Figure 1:
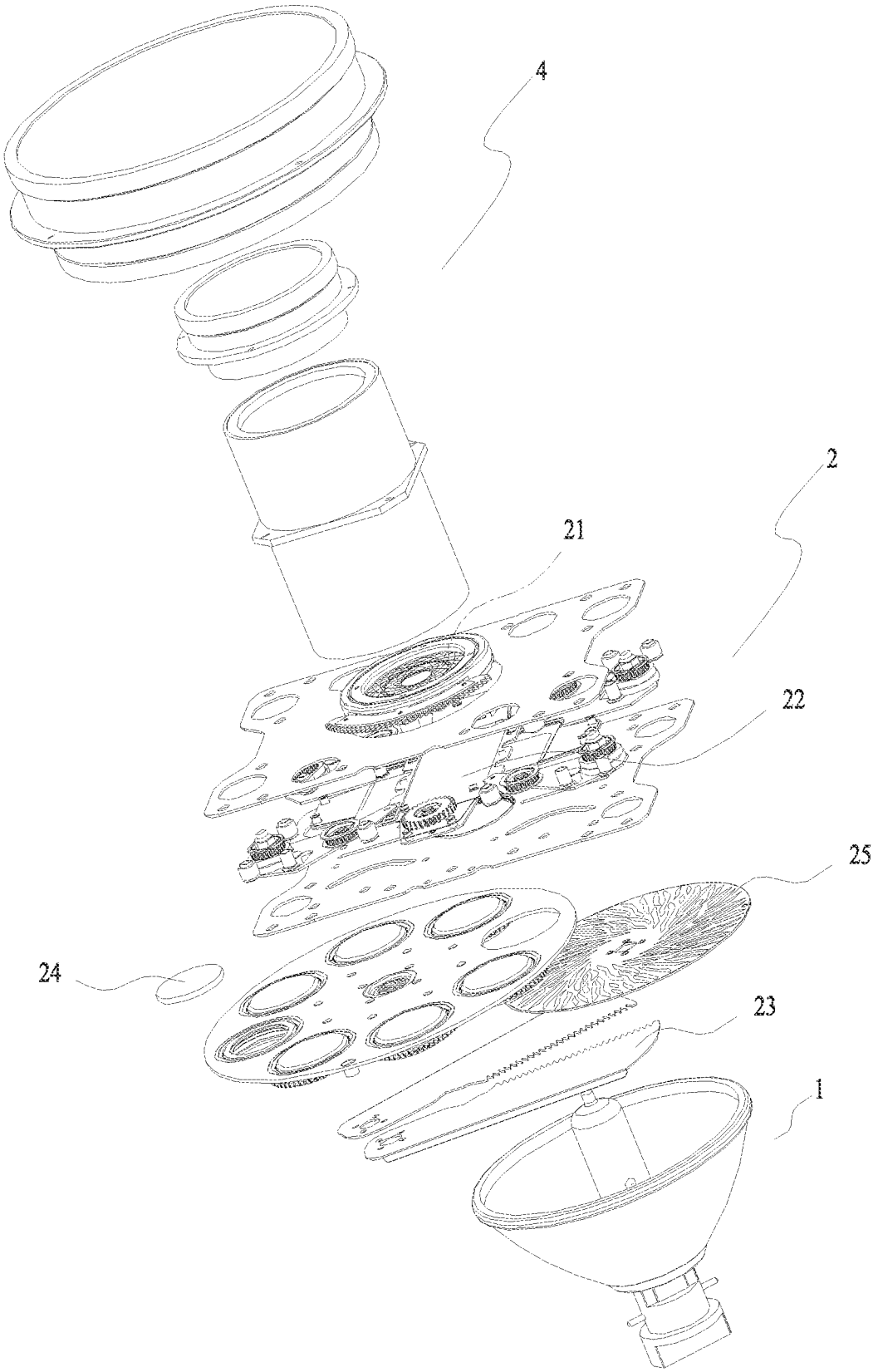
FIG. 1 is a schematic diagram of an overall structure of a stage light having an effect element made of a ceramic material according to an embodiment.

As shown in FIG. 1, the present embodiment provides a stage light having an effect element made of a ceramic material, comprising a light source 1, an effect element 2, and a driving component 3 connected to the effect element 2, wherein light emitted by the light source 1 forms a light beam, the effect element 2 is made of a ceramic material, and the driving component 3 drives the effect element 2 to rotate or move relative to the light beam so as to enable the light beam to generate a corresponding lighting effect.

The stage light has various lighting effects by means of the effect element 2 made of a ceramic material. Since ceramic is less susceptible to thermal deformation and has a higher temperature resistance than metal, the configuration of the effect element 2 with a ceramic material can effectively reduce thermal deformation and cracking, thereby prolonging the service life of the effect element 2.

Optionally, the effect element 2 is directly made of a ceramic material or is made of a ceramic material covered with a base material, and the ceramic material can be black ceramic, oxide ceramic, nitride ceramic, or other high-temperature resistant ceramic materials. In one preferred embodiment, the effect element 2 is entirely made of the ceramic material.

In a preferred embodiment according to the present invention, the stage light further comprises a fixing mechanism 31 for fixing the effect element 2 to the driving component 3, and an elastic pad 311 is provided at a position where the effect element 2 is connected to the fixing mechanism 31. The fixing mechanism 31 clamps two gaskets by means of screws so as to fix the effect element 2 located between the two gaskets. In addition, the elastic pad 311 between the gaskets and the effect element 2 can buffer the vibration of the effect element 2 or prevent the effect element 2 from being damaged due to excessive pressure during clamping.

In a preferred embodiment according to the present invention, the effect element 2 is one or more components selected from the group of a blade 21 of an aperture, a cutting blade 22 of a cutter, a stroboscopic sheet 23, a gobo blade 24 on a rotating gobo wheel, a fixed gobo wheel, and a dynamic gobo wheel 25. In which, after passing through the dynamic gobo wheel 25, the light beam can project a gobo of flame, white cloud, flowing water, starry sky, etc., that is, the dynamic gobo wheel 25 may be a fire wheel, a flow cloud wheel, a water wave wheel or a starry sky wheel, so as to achieve more abundant performance effects of the stage light.

In a preferred embodiment according to the present invention, the ceramic material for making the effect element 2 is black. With the light absorption property of the black color, the possibility of light transmission of the dynamic gobo wheel is reduced. The black ceramic material can be made by mixing black pigment, such as isomorphous mixed spinel series, with porcelain clay.

Optionally, the ceramic material for making the effect element 2 is gray.

In a preferred embodiment according to the present invention, at least one side surface, away from the light source 1, of the effect element 2 is spray-coated with black paint. After the light beam 2 passes through the effect element, stray light reflected by other elements can be absorbed by the surface, spray-coated with black paint, of the effect element 2. Meanwhile, the spray-coating with black paint can reduce the light transmission of the effect element 2 to achieve a better shading effect.

Optionally, both the sides, away from the light source 1 and close to the light source 1, of the effect element 2 are spray-coated with black paint to further reduce the light transmission of the effect element 2.

Optionally, the side, close to the light source 1, of the effect element 2 is a polished surface, and the side away from the light source 1 is a frosted surface. The polished surface used as the side close to the light source 1 can enhance the light reflection to avoid high concentration of heat, thereby prolonging the service life of the effect element 2. The frosted surface used as the side away from the light source 1 can prevent the effect element 2 from reflecting stray light that will affect the light emitting effect of the stage light if it is mixed with the light beam of the light source 1 and emitted out.

Preferably, the effect element 2 has a thickness of 0.2 mm-1.5 mm. In this embodiment, the effect element 2 has a thickness of 0.8 mm or 1.0 mm or 1.2 mm, such that the effect element 2 can be made light in weight and thin enough on the premise of ensuring the opacity.

Figure 2:
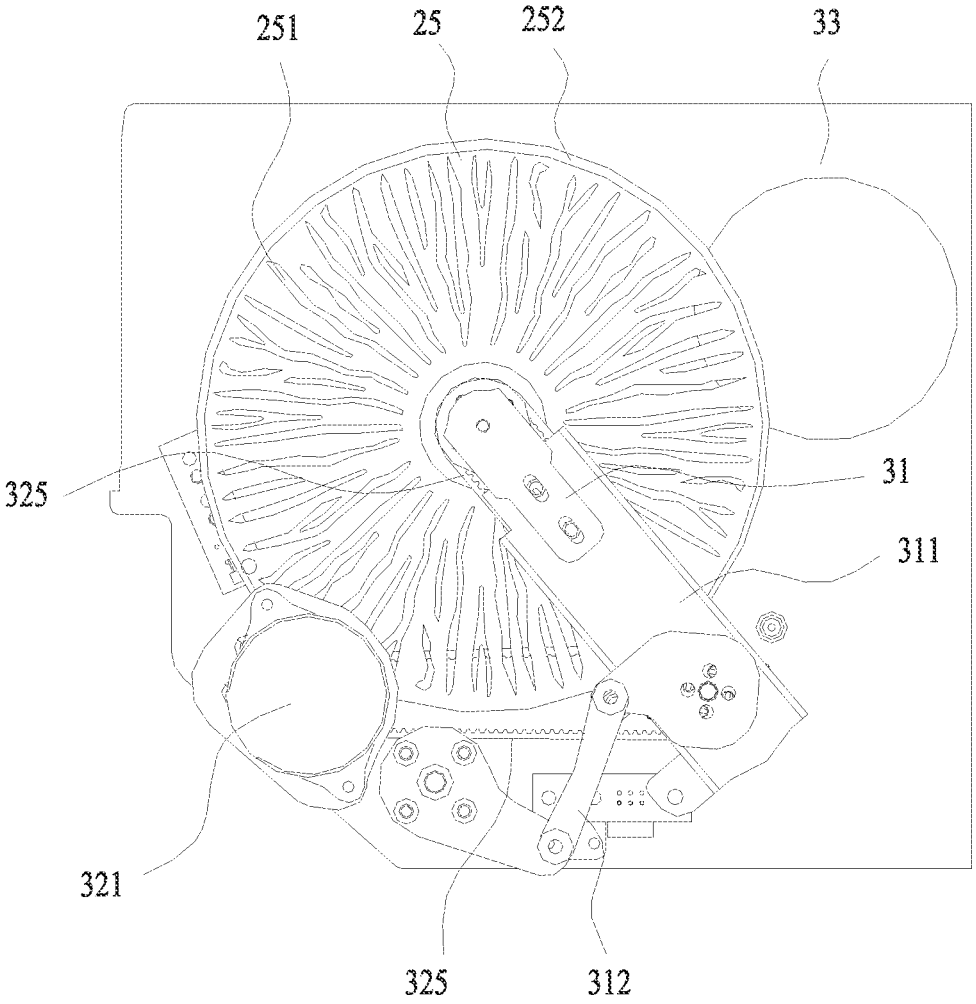
FIG. 2 is a schematic diagram of a drive for a dynamic gobo wheel according to an embodiment.
Figure 3:
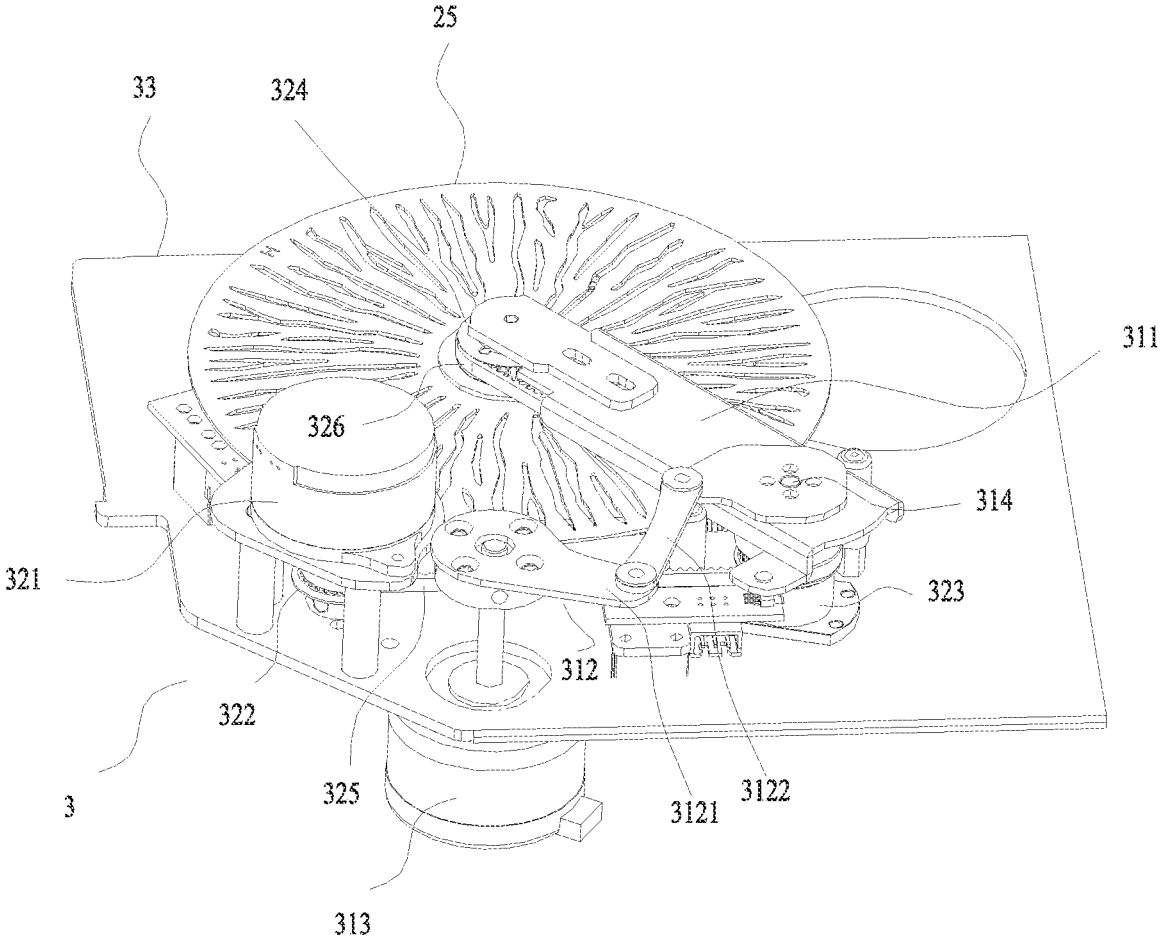
FIG. 3 is another schematic diagram of a drive for the dynamic gobo wheel according to the embodiment.

As shown in FIGS. 2 and 3, preferably, according to the present embodiment, the effect element 2 is a dynamic gobo wheel 25, the dynamic gobo wheel 25 is provided with a plurality of hollowed-out holes 251 or transparent areas for generating a lighting effect, and the periphery of the dynamic gobo wheel 25 is provided with a buffer pad 252. By means of providing the hollowed-out holes 251 or the transparent areas, more gobos can be shown to achieve the gorgeous effect of the stage light. in addition, the buffer spacer 252 is arranged at the periphery of the dynamic gobo wheel 25 so that the dynamic gobo wheel 25 can be protected more comprehensively, and damage caused by collision or scratching can be avoided in the working process of the dynamic gobo wheel.

In another preferred embodiment according to the present invention, the buffer pad 252 is ring-shaped, and covers the periphery of the dynamic gobo wheel 25. The dynamic gobo wheel 25 is wrapped all around with an annular structure.

Referring to FIGS. 2 and 3, in another preferred embodiment according to the present invention, the dynamic gobo wheel 25 is driven by the driving component 3 which is supported on a mounting plate 33. The driving component 3 comprises a movement driving mechanism. The movement driving mechanism comprises a swing arm 311, a mechanical connecting rod 312, and a movement driving electric motor 313. The dynamic gobo wheel 25 is pivoted to one end of the swing arm 311, the other end of the swing arm 311 is pivoted to the mounting plate 33 by a rotary pivoting shaft 314, and a rotating shaft of the movement driving electric motor 313 is connected to the swing arm 311 by the mechanical connecting rod 312. In operation, the movement driving electric motor 313 drives the mechanical connecting rod 312 to rotate, and the mechanical connecting rod 312 drives the swing arm 311 to rotate around a pivot point where the swing arm 311 is pivoted to the mounting plate 33, so that the gobo wheel 25 moves relative to the light beam, i.e. switch in and out the light path, thereby generating dynamic gobo effects.

According to a preferred embodiment, the mechanical connecting rod 312 includes a first connecting rod 3121 and a second connecting rod 3122. The first connecting rod 3121 is connected to the rotating shaft of the movement driving electric motor 313, and is further pivoted to one end of the second connecting rod 3122. The other end of the second connecting rod 3122 is connected to the swing arm 311. In operation, the movement driving electric motor 313 drives the first connecting rod 3121 to rotate, the first connecting rod 3121 drives the second connecting rod 3122 to move, and the second connecting rod 3122 drives the swing arm 311 to rotate around a pivot point where the swing arm 311 is pivoted to the mounting plate 33, so that the gobo wheel 25 moves relative to the light beam, i.e. switches in and out the light path, thereby generating dynamic gobo effects.

In another embodiment, the driving component 3 comprises a rotation driving mechanism having a rotation driving electric motor 321, a rotation driving gear 322, a first rotation driven gear 323 and a second rotation driven gear 324. The rotation driving gear 322 is fixedly connected to a rotating shaft of the rotation driving electric motor 321, the second rotation driven gear 324 is fixed to the dynamic effect wheel 25, and the first rotation driven gear 323 is respectively connected to the rotation driving gear 322 and the second rotation driven gear 324 by means of a synchronous belt 325, 326. In operation, the rotation driving electric motor 321 drives the rotation driving gear 322 to rotate, the rotation driving gear 322 drives the first rotation driven gear 323 to rotate by the synchronous belt 325, and the first rotation driven gear 323 drives the second rotation driven gear 324 to rotate by the synchronous belt 326, so that the gobo wheel 25 rotates, thereby increasing dynamic gobo effects.

In another preferred embodiment, the first rotation driven gear 323 is pivoted to the rotary pivoting shaft 314.

The swing arm 311 can be hollow. The synchronous belt 326 positioned in the swing arm 311.

It can be known that, the dynamic gobo wheel 25 can be driven to move or rotate respectively, or to more or rotate simultaneously. The gobo wheel 25 is driven by the movement driving mechanism to switch in or out the light path, and to rotate by the rotation driving mechanism, thereby generating varied dynamic gobo effect.

As shown in the FIG. 1, the stage light further comprises a plurality of optical components 4, the light beam emitted by the effect element 2 is further processed by the plurality of optical components 4, and then output by the optical components 4. Obviously, the above-mentioned embodiment of the present invention are merely examples made for clearly describing the present invention, but do not limit implementations of the present invention. For those of ordinary skill in the art, other different forms of changes or variations could have also been made on the basis of the above-mentioned illustration. There is no need and no way to exhaustively list all implementations here. Any modifications, equivalent replacements, improvements, and the like made within the spirits and principles of the present invention should be included within the scope of protection of the present invention.

What is claimed is:

1. A stage light having an effect element made of a ceramic material, the stage light comprising a light source, light emitted by the light source forming a light beam;

an effect element made of a ceramic material; and a driving component connected to the effect element, wherein the driving component drives the effect element to rotate or move relative to the light beam so as to enable the light beam to generate a corresponding lighting effect; wherein the effect element is a dynamic gobo wheel provided with a plurality of hollowed-out holes or transparent areas for generating a lighting effect, the periphery of the dynamic gobo wheel is provided with a ring-shaped buffer pad configured to cover the periphery of the dynamic gobo wheel.

2. The stage light having an effect element made of a ceramic material according to claim 1, further comprising a fixing mechanism for fixing the effect element to the driving component, wherein an elastic pad is provided at a position where the effect element is connected to the fixing mechanism.

3. The stage light having an effect element made of a ceramic material according to claim 1, wherein the effect element is one or more components selected from the group of a blade of an aperture, a cutting blade of a cutter, a stroboscopic sheet, a gobo sheet on a rotating gobo wheel, a fixed gobo wheel, and a dynamic gobo wheel.

4. The stage light having an effect element made of a ceramic material according to claim 1, wherein the driving component comprises a movement driving mechanism, the movement driving mechanism comprises a swing arm, a mechanical connecting rod, and a movement driving electric motor, the effect element is pivoted to on end of the swing arm, other end of the swing arm is pivoted to a mounting plate by means of a rotary pivoting shaft, and a rotating shaft of the movement driving electric motor is connected to the swing arm by means of the mechanical connecting rod.

5. The stage light having an effect element made of a ceramic material according to claim 4, wherein the mechanical connecting rod includes a first connecting rod and a second connecting rod, the first connecting rod is connected to the rotating shaft of the movement driving electric motor, and is further pivoted to one end of the second connecting rod, other end of the second connecting rod is connected to the swing arm.

6. The stage light having an effect element made of a ceramic material according to claim 1, wherein the driving component comprises a rotation driving mechanism having a rotation driving electric motor, a rotation driving gear, a first rotation driven gear, and a second rotation driven gear, the rotation driving gear is fixedly connected to a rotating shaft of the rotation driving electric motor, the second rotation driven gear is fixed to the effect element, and the first rotation driven gear is respectively connected to the rotation driving gear and the second rotation driven gear by a first synchronous belt and a second synchronous belt.

7. The stage light having an effect element made of a ceramic material according to claim 4, wherein the driving component comprises a rotation driving mechanism having a rotation driving electric motor, a rotation driving gear, a first rotation driven gear, and a second rotation driven gear, the rotation driving gear is fixedly connected to a rotating shaft of the rotation driving electric motor, the first rotation driven gear is pivoted to the rotary pivoting shaft, the second rotation driven gear is fixed to the effect element, and the first rotation driven gear is respectively connected to the rotation driving gear and the second rotation driven gear by a first synchronous belt and a second synchronous belt.

8. The stage light having an effect element made of a ceramic material according to claim 7, wherein the second synchronous belt is positioned in the swing arm.

9. The stage light having an effect element made of a ceramic material according to claim 1, wherein the ceramic material for making the effect element is black or gray.

10. The stage light having an effect element made of a ceramic material according to claim 1, wherein at least one side surface, away from the light source, of the effect element is spray-coated with black paint.

11. The stage light having an effect element made of a ceramic material according to claim 1, wherein the effect element has a thickness of 0.2 mm to 1.5 mm.

12. The stage light having an effect element made of a ceramic material according to claim 1, wherein the effect element is made of a ceramic material covered with a base material, or the effect element is entirely made of a ceramic material.

* * * * *